US005616048A

United States Patent [19]

Myer et al.

[11] Patent Number: 5,616,048

[45] Date of Patent: Apr. 1, 1997

[54] ELECTRICAL CONNECTOR WITH ELECTRICAL CONTACT AND STRAIN RELIEF

[75] Inventors: John M. Myer, Millersville; John R. Shuey, Mechanicsburg; Kenneth F. Folk, Harrisburg, all of Pa.

[73] Assignee: The Whitaker Corporation, Wilmington, Del.

[21] Appl. No.: 495,163

[22] Filed: Jun. 26, 1995

[51] Int. Cl.[6] ..... H01R 13/40

[52] U.S. Cl. ..... 439/398; 439/468; 439/598; 439/902

[58] Field of Search ..... 439/398–401, 439/404–407, 468, 470, 473, 701, 902, 942, 752, 686, 695, 733.1, 746, 598

[56] References Cited

U.S. PATENT DOCUMENTS

| | | | |
|---|---|---|---|
| 3,997,234 | 12/1976 | Worman | 439/456 |
| 4,062,610 | 12/1977 | Doty et al. | 439/264 |
| 4,145,103 | 3/1979 | Knowles | 439/400 |
| 4,350,404 | 9/1982 | Clark et al. | 439/398 |
| 4,514,024 | 4/1985 | Seidel | 439/942 |
| 4,801,278 | 1/1989 | Sappington | 439/746 |
| 4,820,179 | 4/1989 | Saijo | 439/733.1 |
| 5,015,200 | 5/1991 | Abernethy | 439/357 |
| 5,064,967 | 11/1991 | Singbartl | 174/52.3 |
| 5,120,235 | 6/1992 | Kashiwa | 439/942 |
| 5,136,196 | 8/1992 | Schmidt | 310/71 |
| 5,181,862 | 1/1993 | Hawk et al. | 439/595 |
| 5,249,980 | 10/1993 | Hatagishi | 439/398 |
| 5,290,176 | 3/1994 | Soes et al. | 439/398 |
| 5,380,220 | 1/1995 | Okabe | 439/456 |
| 5,425,657 | 6/1995 | Davis et al. | 439/405 |
| 5,435,758 | 7/1995 | Sasai et al. | 439/752 |

FOREIGN PATENT DOCUMENTS

| | | | |
|---|---|---|---|
| 0448476 | 9/1991 | European Pat. Off. | H01R 13/436 |
| 0505199 | 9/1992 | European Pat. Off. | H01R 13/436 |
| 0519815 | 12/1992 | France | H01R 13/639 |
| 91 03 107.9 | 7/1991 | Germany | H01R 13/506 |
| 2232018 | 11/1990 | United Kingdom | H01R 4/24 |

*Primary Examiner*—P. Austin Bradley
*Assistant Examiner*—Jill DeMello

[57] ABSTRACT

An electrical connector assembly (100) which includes electrical contacts (10) of the insulation displacement type, an inner housing (20), an outer housing (40), and a strain relief meter (50). The assembly (100) is assembled by first securely placing the electrical contacts (10) within the inner housing (20) and then inserting the inner housing (20) into the outer housing (40) so that the electrical contacts (10) can be terminated to wires by using the insulation displacement method of wire recitation. The inner housing (20) is fully inserted into outer housing (40), and is then in a fully latched position within the outer housing (40). Strain relief member (50) is then mounted to outer housing (40) and includes an abutment flange (55) for ensuring that the inner housing (20) has been fully inserted within outer housing (40). The wires which are terminated to the contacts (10) will extend around an inner wall (53) of the strain relief (50) and will be laced between retainer walls (58) so that strain relief will be provided to the assembly (100).

17 Claims, 5 Drawing Sheets

ELECTRICAL CONNECTOR WITH ELECTRICAL CONTACT AND STRAIN RELIEF

The present invention relates to an electrical connector assembly having inner and outer housings with electrical contacts, and a strain relief member provided for wires terminated to the contacts. More particularly, the present invention relates to a robust electrical connector assembly for use with insulation displacement (IDC) type contacts whereby termination of the wires preferably occurs after the connector assembly has been partially assembled.

This case is related to the inventions embodied in docket Nos. 16175 and 16226.

BACKGROUND OF THE INVENTION

A known electrical connector assembly which employs IDC contacts is disclosed in U.S. Pat. No. 5,015,200. An inner housing incorporates pre-terminated IDC contacts and is then inserted into an outer housing header. This connector provides an advantageous low-profile connector assembly; however, the wires must be pre-terminated to the inner housing prior to connection with the header, as the header and inner housing are not adapted to provide termination when the header and inner housing are in a partially assembled state. Additionally, the inner housing does not provide dedicated wire strain relief features, and no further strain relief member is provided in the assembly other than crimp-legs integrally formed on the IDC contacts. Furthermore, the invention does not contemplate a connector position assurance device for ensuring that the inner housing has been fully inserted into the header.

Another known connector assembly is disclosed in U.S. Pat. No. 5,181,862. This assembly is intended to be used in an automotive environment, and includes a header, an inner housing, and a terminal position assurance device. This assembly provides an advantageous way of assuring that electrical interconnections have properly been made; however, the assembly relies on snap-crimp technology, i.e. pre-terminating the wires using crimp technology prior to connection of the wire terminals to the housing. Additionally, the wire strain relief method relies on crimp-legs of the crimp terminals for engaging the wires.

A known IDC terminal is disclosed in U.S. Pat. No. 5,290,176. This known terminal includes a generally U-shaped backup spring section; however, the IDC terminal is not adapted for use as a retaining means for the IDC terminal within a housing. Other IDC terminals with backup sections/are disclosed in the following U.S. Pat. Nos. 4,159,158; 4,255,009; and 4,408,824.

Another electrical connector with dedicated wire strain relief is disclosed in U.S. Pat. No. 5,380,220, which is hereby incorporated by reference in its entirety. This reference discloses an inner housing with wire slots having latching fingers which force a respective wire into a frictionally retained and deformed shape. However, this solution requires crimp-leg strain relief technology, and my cause damage to the wire insulation of small-gauge wires. Additionally, the IDC contacts and wires are terminated before the inner housing is assembled to an outer housing. Other connectors using strain relief are disclosed in U.S. Pat. Nos. 3,997,234, 5,064,967 and 5,136,196.

The present invention overcomes the deficiencies of the prior assemblies and terminal by providing a robust electrical connector assembly wherein the header and inner housing are adapted to withstand IDC termination when the header and inner housing are in a partially assembled state. Additionally, the inner housing includes dedicated wire strain relief features, and a further strain relief member is provided on the assembly. Furthermore, the present invention contemplates a connector position assurance device for ensuring that the inner housing has been fully inserted into the header. Moreover, the assembly of the present invention can be formed in a smaller shape than the prior art because the IDC contacts do not require as much space as traditional crimp-snap terminals.

SUMMARY OF THE INVENTION

The present invention provides an electrical connector assembly comprising: an inner housing with at least one contact receiving slot; at least one electrical contact disposed in the slot; an outer housing with a cavity for receiving the inner housing, the outer housing includes at least one latch am for latching the inner housing within the cavity in first and second latched positions; and the inner housing includes a wall for receiving the latching am in the first and second latched positions. The first position is an intermediate assembly state wherein the electrical contacts are terminated to electrical wires. The inner housing includes a primary latch recess which receives the latch arm in the first latched position, and includes a secondary latch recess which receives the latch arm in the second latched position. Additionally, when the inner housing is disposed in the intermediate, first latched position, a portion of the electrical contact is exposed for the purpose of allowing the termination of electrical wires. In the preferred embodiment of the present invention, the electrical contacts are of the insulation displacement type.

DETAILED DESCRIPTION OF THE INVENTION

Figure 1:
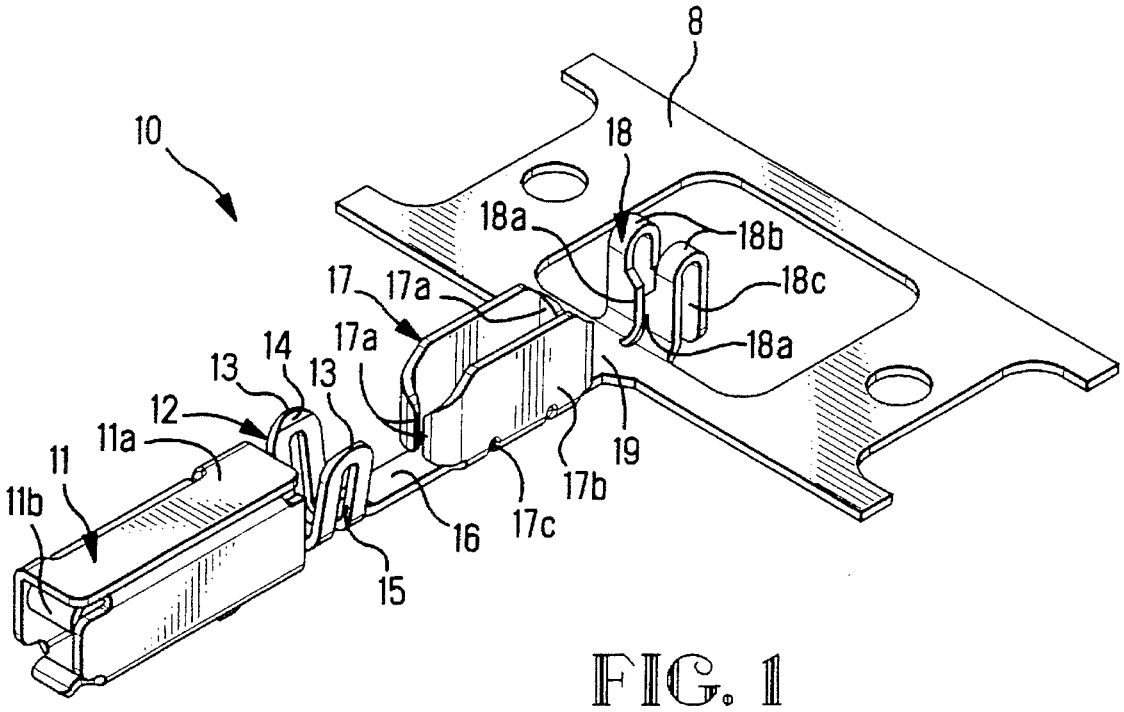
FIG. 1 shows an isometric view of the electrical contact of the present invention while still connected to a carrier strip.

FIG. 1 shows an electrical contact 10 according to the present invention. Contact 10 includes a receptacle section 11 for receiving a pin or blade contact (not shown in the drawing) having a top wall 11*a* and a spring finger 11*b*, a contact retention section 12, a generally box-shaped insulation displacement contact (IDC) section 17, an end IDC section 18 with sharpened blades 18*a* and legs 18*b*, and a carrier strip 8 used for translating the contact 10 through a stamping machine. End IDC section 18 is advantageously formed within the carrier strip 8 during the forming process. Contact retention section 12 includes arcuate beams 13 each having a taper 14 formed thereon. Each arcuate beam 13 includes a slot 15 which extends from one taper 14 to the bottom of contact 10 and then up to the other taper 14, thereby defining, in combination with arcuate beams 13, a flexible joint between the receptacle section 11 and the IDC section 17. This flexibility is desirable as a vibration isolating device. Contact retention section 12 is connected to box IDC section 17 by a middle base portion 16 from which walls 17*b* of IDC section 17 are bent upwardly. Walls 17*b* include strengthening divots for controlling the deflection of walls 17*b* during termination of a wire. Base portion 16 is advantageously sized to allow a length of wire to extend past box section 17 for permitting a secure electrical termination. On the opposite side of box IDC section 17 relative to base section 16, there is a rear base section 19 which connects the box IDC section 17 with end IDC section 18. Box IDC section 17 includes cutting blades with chamfers 17*a* formed thereon for penetrating the insulation of a wire to be disposed in the contact 10 (not shown in the drawing), and electrically engaging the conductive core of the wire. The blades 18*a* of end IDC section 18 are also shaped to penetrate the insulation of a wire to be terminated in contact 10, and to electrically engage the conductive core of the wire. Blades 17*a* are preferably formed by a coining and stamping process.

Moreover, legs 18*b*, although resilient, are nevertheless adapted to grippingly engage and support the insulation of the wire inserted into contact 10 and to provide a spring assist to blades 18*a*. In this way, end IDC section 18 provides a mechanical and electrical connection to the wire; however, section 18 also provides strain relief of the wire, thereby preserving the electrical termination at IDC section 17 from damage due to forces acting on the wire. Additionally, a gap 18*c* is configured to internally frictionally accommodate a portion of the inner housing 20, as will be described below, thereby axially securing the contact 10 within the inner housing.

Figure 2:
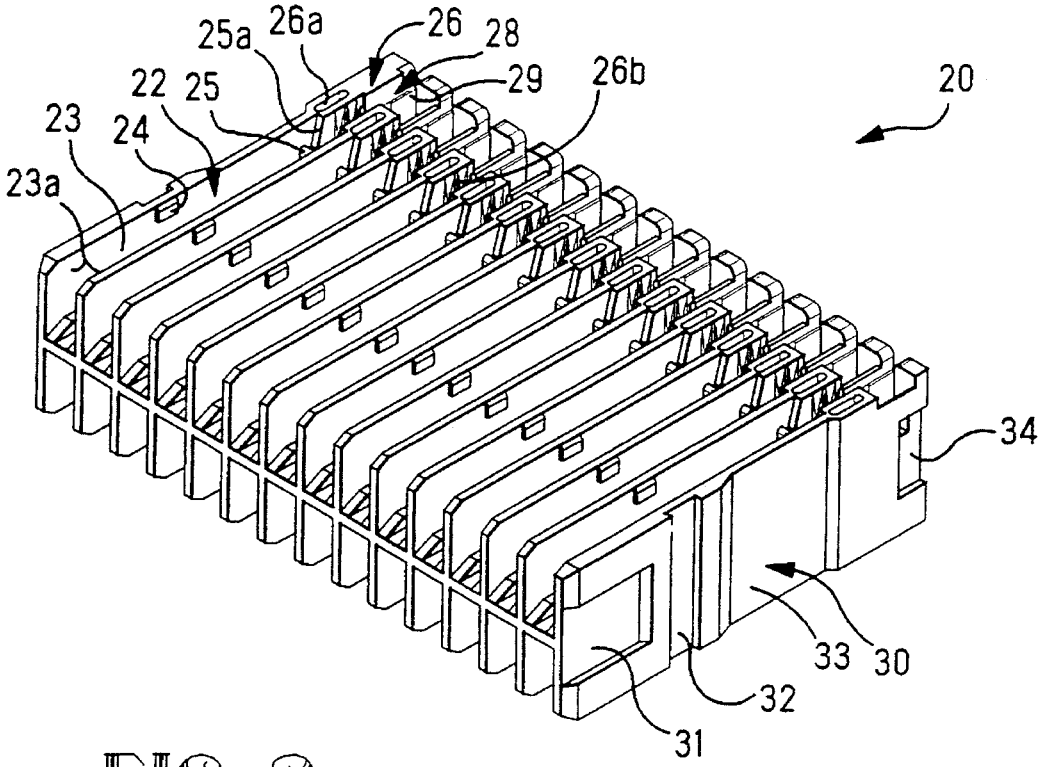
FIG. 2 Shows an isometric view of the inner housing according to the present invention.

FIG. 2 shows the inner housing 20 according to the present invention. Inner housing 20 includes a contact slot 22 having a contact receiving section 23 with walls 23*a*, a pair of contact retention embossments 24 (see FIG. 3), and a contact retention Clip 25 having a tapered wall 25*a*. Contact receiving slot 22 is sized to receive contact 10 of FIG. 1 so that the receptacle section 11 of Contact 10 will be disposed in contact receiving section 23, and the arcuate bee 13 of contact retention section 12 of contact 10 will resiliently engage contact retention embossments 24 thereby providing a vertical retention feature for contact 10. Additionally, gap 18*c* is sized to resiliently receive contact retention clip 2B adjacent to tapered walls 25*a*, which thereby provides an axial retention feature for the contact 10 within inner housing 20.

Figure 3:
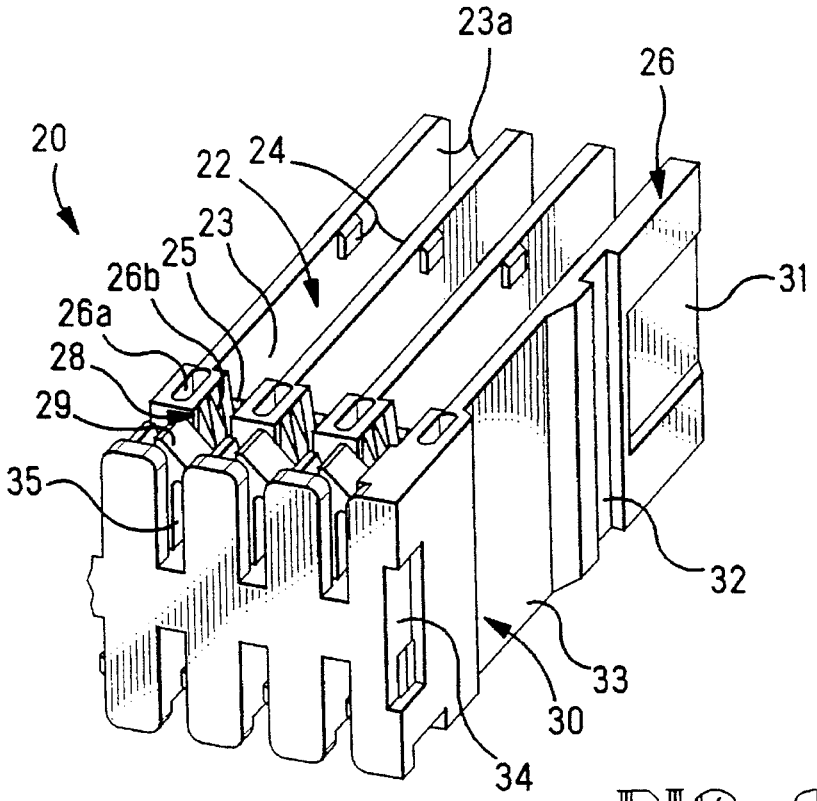
FIG. 3 shows an isometric view of the wire exit portion of the inner housing of FIG. 2.

Inner housing 20 also includes a wall 26 having a void area 26*a* and serrated ridges 26*b* (see FIG. 3). Void 26*a* allows for flexibility of the housing material as a wire inserted into housing 20 will press against serrations 26*b* and thereby tend to close void 26*a*. In another advantage of the invention, the serrations allows for wire strain relief thereby eliminating the need for crimp-leg type strain relief of the prior art. Adjacent to wall 26 a wire exit slot 28 is formed with a latching finger 29 for latchably receiving a wire to be inserted in inner housing 20.

On the outer side of inner housing 20 a side wall 30 is formed, which wall includes a lead-in recess 31, a primary latch recess 32, an intermediate recess 33, and a secondary latch recess 34. Primary latch recess 32 is adapted to receive an outer housing latch for defining a first position of the inner housing 20 whereby wires can be terminated in the IDC sections of contact 10. Secondary latch recess 34 will receive the housing latch after the wire terminations have been completed and the inner housing 20 has been fully inserted into the outer housing, as will be more fully described below.

Referring to FIG. 3 a rear view of the inner housing 20 of FIG. 2 is shown. The position of slot 35 shows where a wire will be vertically and axially retained by serrations 26*b* and latching finger 29, and where the wire will exit from the rear of inner housing 20 after the wire has been terminated in a respective contact 10. It is, however, contemplated that the slot 35 can be formed with a V-shaped profile for enhancing its retaining function.

Figure 4:
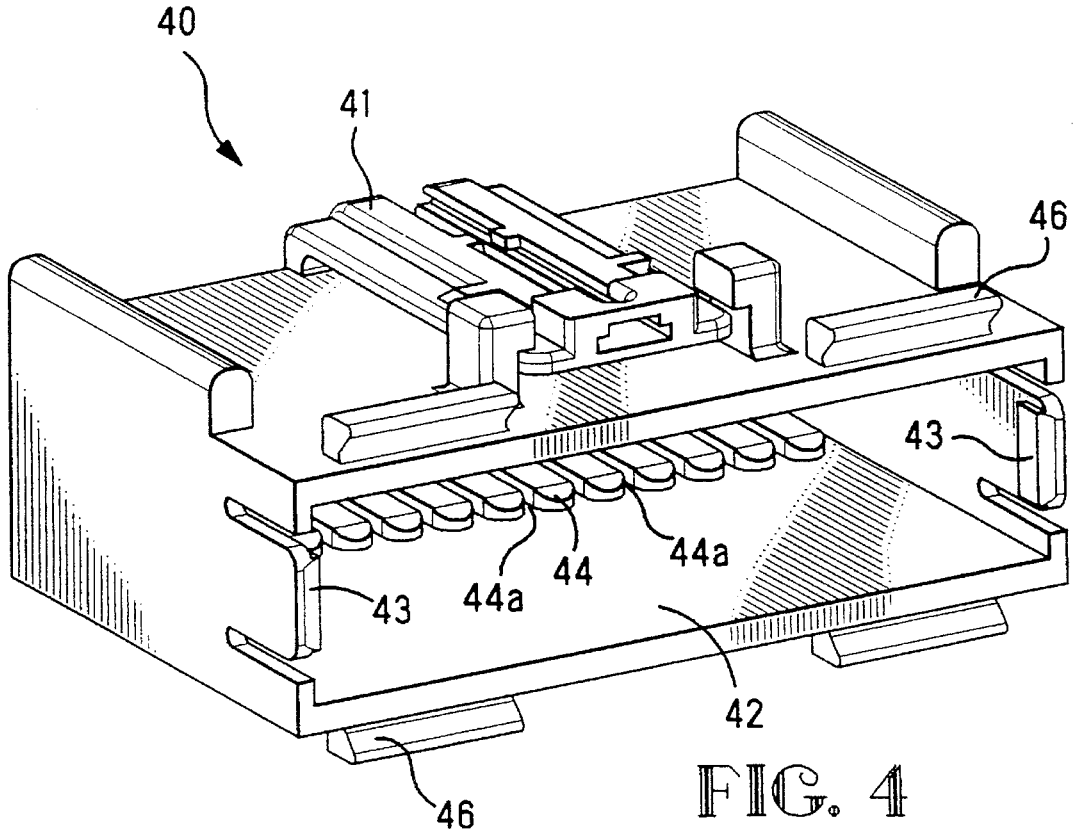
FIG. 4 shows an isometric view of the outer housing according to the present invention.

FIG. 4 shows an outer housing 40 according to the present invention. Outer housing 40 includes a deflectable housing latch arm 41, an aperture 42 for receiving inner housing 20 of FIG. 2 therein, a pair of resilient latch arms, ribs 44, and a plurality of lugs 46. After inner housing 20 has been assembled with electrical contacts 10 therein, inner housing 20 will be inserted into aperture 42 so that latch arms 43 will be received within respective lead-in recesses 31 along the side of inner housing 20.

Next, inner housing 20 will be moved from the lead-in position to the first latched position whereby latch arms 43 will be deflected outwardly so that the latch arms 43 will advance into a latched position within primary latch recess 32. At this point, wires will be terminated into the IDC sections of contact 10*a* which will result in a plurality of wires exiting from wire slots 35 of inner housing 20. After the wire termination procedure has been completed, the inner housing 20 will be further inserted into aperture 42 of outer housing 40. As this occurs, latch arms 43 will again be deflected outwardly along wall 30 of inner housing 20 and will further advance past intermediate recess 33, and ultimately latching arms 43 will be advanced to their second or final latched position at secondary latch recess 34. At this second latched position, inner housing 20 is fully received and latched within outer housing 40.

When outer housing 40 has thus fully received inner housing 20, it is important to note that contact slot walls 23*a* of inner housing 20 will be inserted into slots 44*a* between ribs 44. Ribs 44 will engage top wall 11*a* of receptacle section 11 of contact 10 and thereby retain the position of contact 10 when the pin or tab engages the spring finger 11*b* of contact section 11. In this way, the contact 10 will not be vertically displaced, and stubbing of the pin or tab contact will be avoided. Finally, housing latch arm 41 is adapted to receive a connector position assurance device (not shown in the drawing) and the outer housing 40 with inner housing 20 therein is received in an aperture of a header member having tab or pin contacts (not shown in the drawing).

Figure 5:
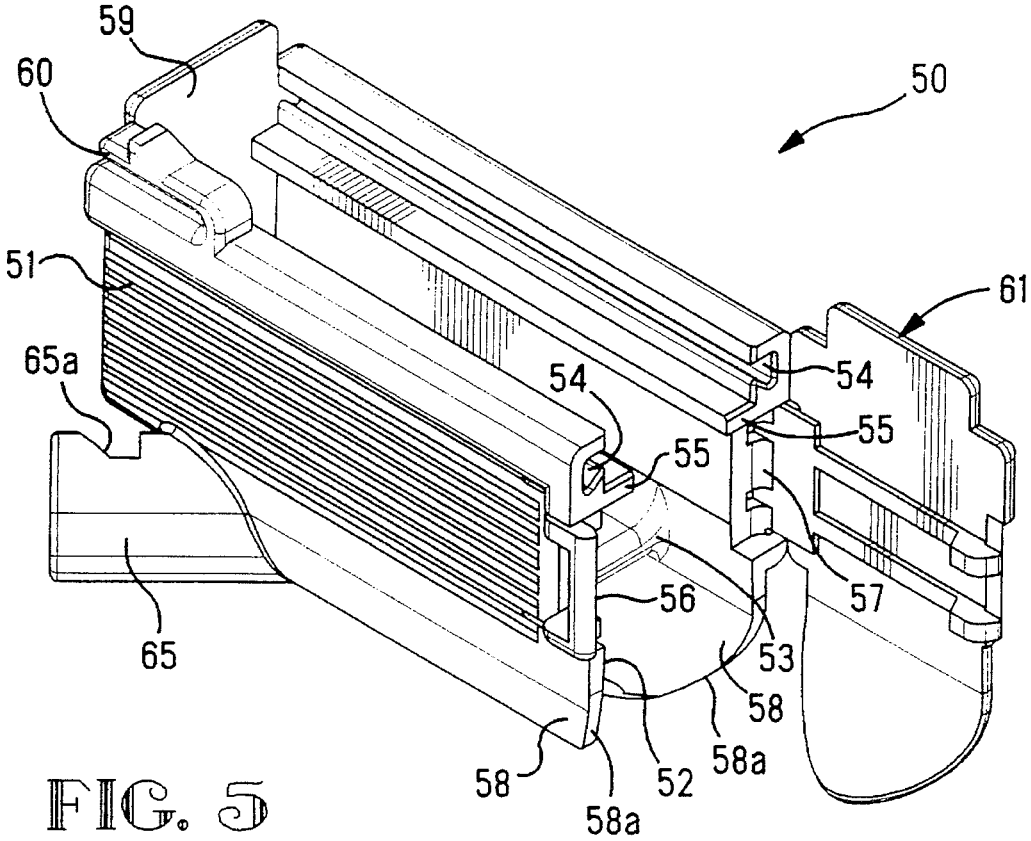
FIG. 5 shows an isometric view of the strain relief member according to the present invention.

FIG. 5 shows a strain relief member 50 for use with the present invention. Strain relief member 50 includes: a top wall 51; a bottom wall 52; an inner wall 53 which extends between top wall 51 and bottom wall a groove 54 which is shaped for receipt of lugs 46; a flange 55 which is adapted to abut the inner housing 20 if the inner housing is not fully in place within outer housing 40, which thereby acts as a connector position assurance device; a latch 56; a hinge 57; retainer walls 58 having arcuate edges 58*a* for receiving and retaining a plurality of wires therein, and having a gap 58*b*; and a side wall 59 which acts as a stop for engaging the side of outer housing 40. Additionally, a resilient latching arm 60 is provided on a front face of strain relief member 50 for latching the strain relief member in place on the housing 40 (see FIG. 8). Moreover, it is contemplated that the wall 53 Can be formed with a punch-out section for the purpose of receiving wires therethrough when a "short-cut" wiring route is needed as, for example, when a wire has been shortened due to breakage.

Figure 6:
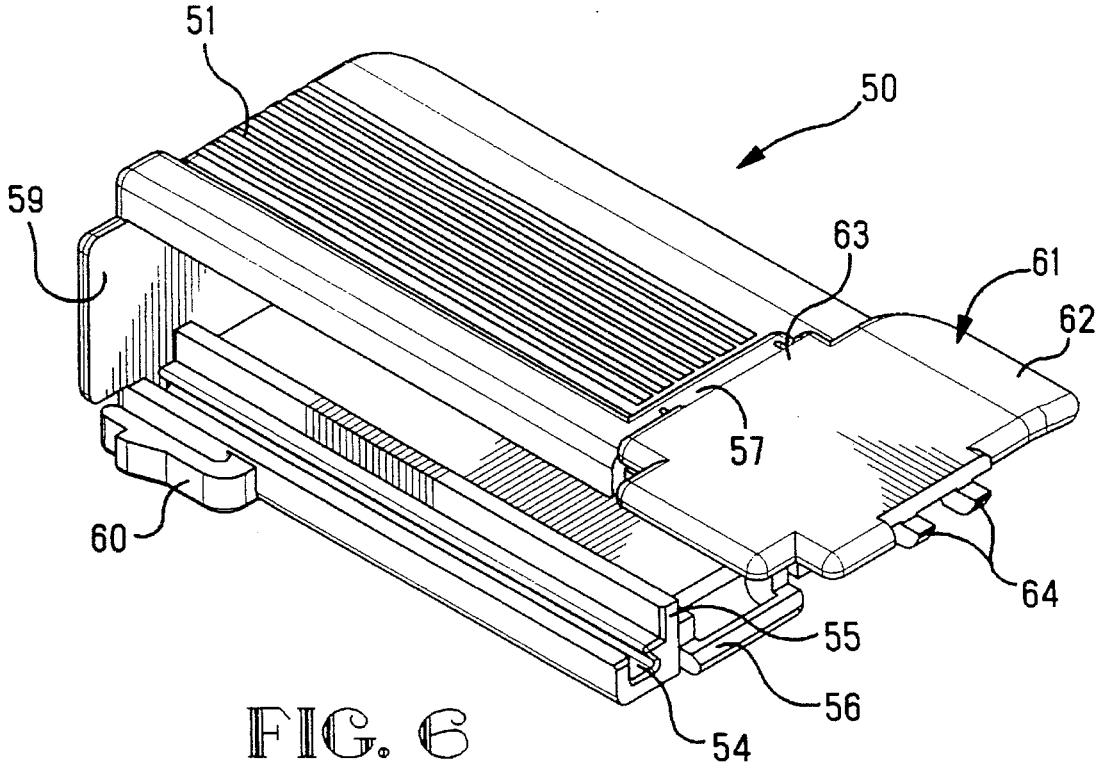
FIG. 6 shows an isometric view of the strain relief member of FIG. 5 but with a cover mounted on an end thereof.

FIG. 6 Shows the strain relief member of FIG. 5 but with a cover 61 installed on hinge 57 adjacent to hinge area 63. Lugs 64 lockingly engage latch bar 56 when the cover 61 is in a closed position. Retainer walls 58 include arcuate sections 58*a* with a gap 58*b* for forcing a bundle of wires between walls 58 toward inner wall 53.

Figure 7:
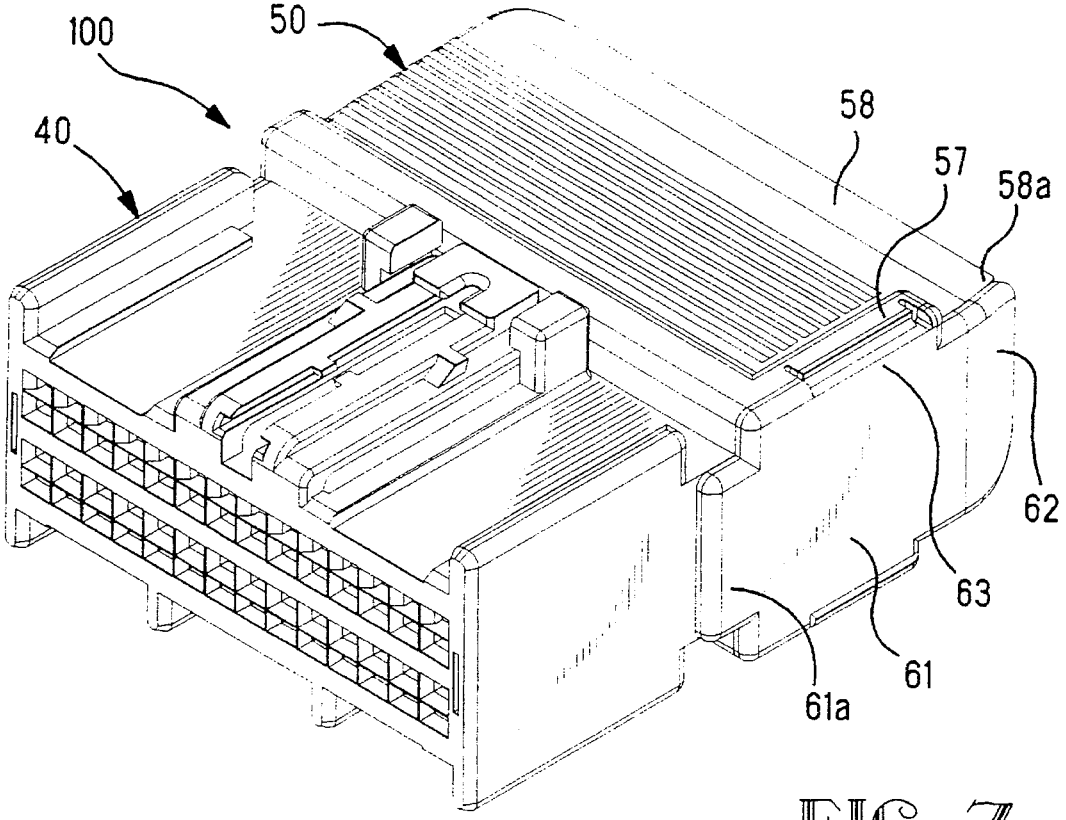
FIG. 7 shows an isometric view of the strain relief member of FIG. 6 mounted to the outer housing of FIG. 4.

FIG. 7 shows a connector assembly 100 comprising the strain relief member 50 installed on outer housing 40 with the cover 61 in a closed position, and the inner housing installed in outer housing 40 with contact 10 therein (not shown). When the connector 100 is fully assembled with wires terminated in contact 10 and the inner housing 20 is in a fully latched, second position within outer housing 40, the wires will protrude out of the back of inner housing 20. The wires will be disposed in a tortuous path as they will: exit the inner housing 20; turn 90 degrees toward cover 61; be laced around inner wall 53 in a 180 degree turn; be guided by arcuate wall 62 of cover 61 in the 180 degree turn; and will be forcibly laced in gap 58*b* between and within retainer walls 58. Thus the wires will be snugly disposed in strain relief member 50 so that the tortuous path will absorb any forces acting on the wares externally of the connector assembly 100. This strain relief feature contributes to the elimination of the need for prior art type crimp-leg strain relief.

Figure 8:
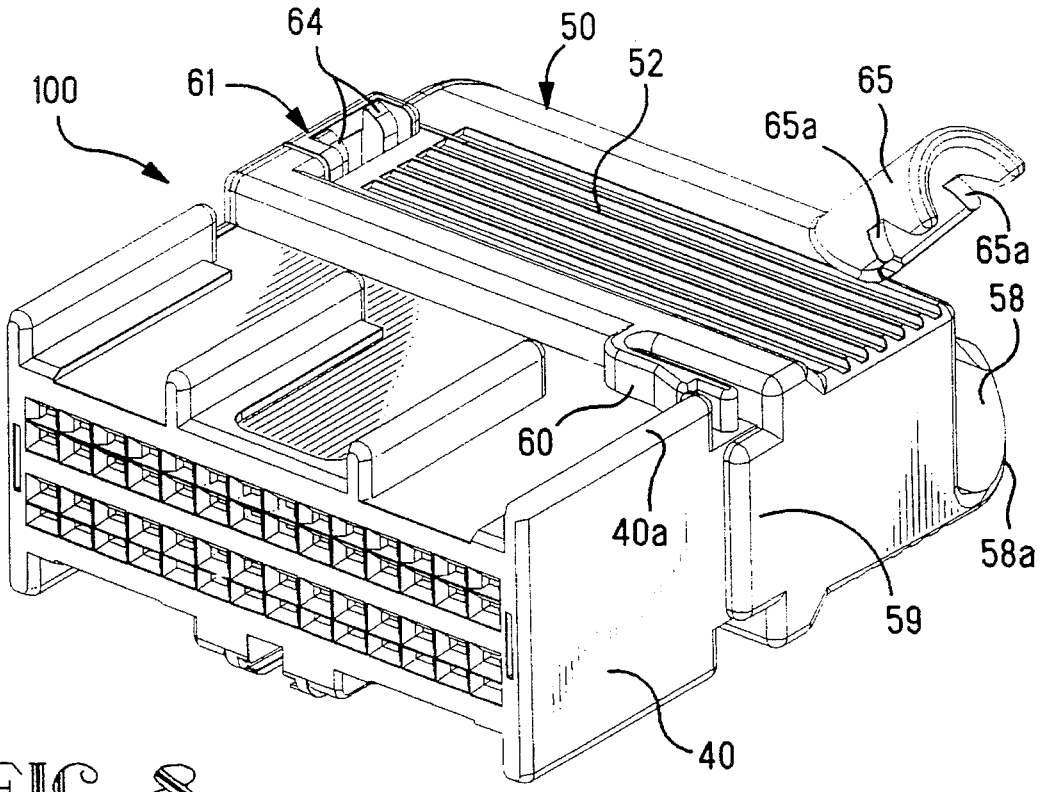
FIG. 8 shows the outer housing and strain relief member of FIG. 7 rotated 180° about a contact insertion axis.

As shown in FIG. 8, which is a bottom view of the connector assembly 100 of FIG. 7, the wires will then extend out of wire trough 65. Wire trough 65 includes a notch area 65*a* for preferably receiving a tie-wrap therearound (not shown in the drawing) thereby tightly securing and supporting the wires to trough 65 and strain relief member 50.

Figure 9:
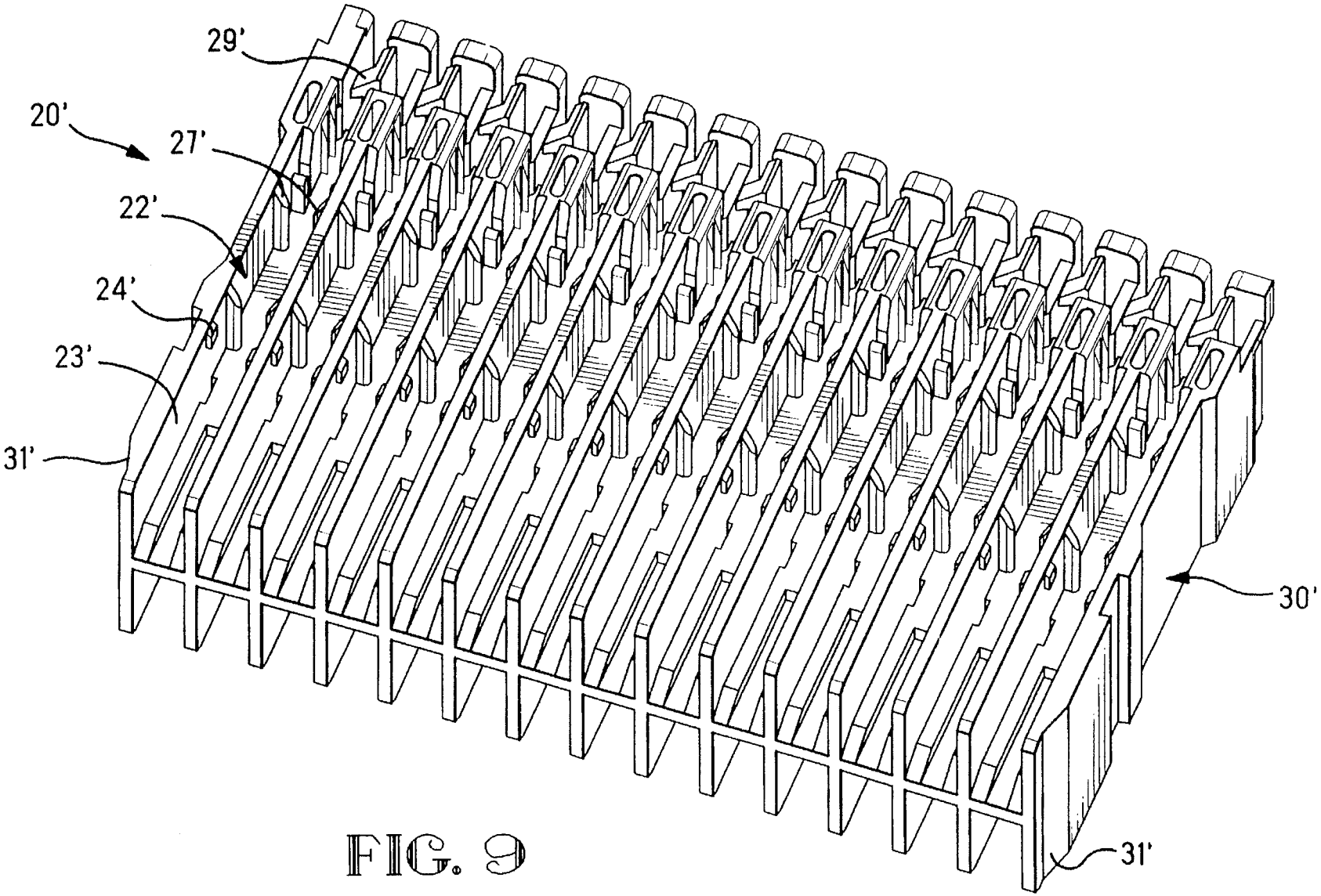
FIG. 9 shows an alternative embodiment of the inner housing of FIG. 2.

Now referring to FIG. 9, an alternative embodiment 20' of the inner housing 20 will be described. The essential differences between the inner housing embodiments 20, 20' are as follows: slot 22' is shown with contact receiving slot 23' having embossments 24' in a staggered configuration to facilitate the molding process; wire guides 27 have been added to slot 22' for the purpose of guiding and retaining a wire to be terminated in contact 10, the guides 27 are in the form of ribs and are spaced to have the box IDC section 17 disposed therebetween when the contact 10 is in place; latching finger 29' is reconfigured to facilitate molding process; and lead in ramps 31' are arranged for guiding the outer housing latch 41.

The preferred engineering material for the electrical contact 10 will comprise a metal having sufficient spring characteristics, high strength, high conductivity, and a low cost. For example, the contacts are preferably formed of such metals as copper, brass, bronze, beryllium copper, copper alloys, steel, nickel, aluminum, and zinc. It is further contemplated that the electrical contacts can be coated or plated for corrosion resistance. Additionally, it is contemplated that the inner housing, outer housing, and strain relief member will be formed of a suitable dielectric material, for example: the inner housing is preferably made of an unfilled PBT, while the outer housing is a filled PBT material, e.g. a 30% glass filled material, or even a polypropelene material. It is therefore contemplated that the inner housing material will advantageously exhibit a higher degree of compliancy relative to the outer housing material.

Thus, while a preferred embodiment of the invention has been disclosed, it is to be understood that the invention is not to be strictly limited to such an embodiment but may be otherwise variously embodied and practiced within the scope of the appended claims.

Accordingly, what is claimed is:

1. An electrical connector assembly, comprising:

an inner housing with at least one contact receiving slot;

at least one electrical contact disposed in said slot, the contact having a termination section;

an outer housing with a cavity for receiving said inner housing completely within the cavity, said outer housing includes at least one latch arm for latching said inner housing within said cavity in first and second latched positions when the inner housing is in the first latched position, the termination section of the contact is exposed for termination, when the inner housing is in the second latched position, the inner housing is completely received within the cavity and the termination section is covered; and said inner housing includes a wall shaped to receive said latching arm in said first and second latched positions.

2. The connector assembly of claim 1, wherein said inner housing slot includes at least one embossment for retaining said electrical contact.

3. The connector assembly of claim 1, wherein said inner housing slot includes at least one clip for retaining said electrical contact.

4. The connector assembly of claim 1, wherein said inner housing includes a serrated section for frictional engagement with a wire to be terminated with said electrical contact and for strain relief of the wire.

5. The connector assembly of claim 1, wherein said inner housing includes a latching finger for frictional engagement with a wire to be terminated with said electrical contact.

6. The connector assembly of claim 1, wherein said outer housing includes at least one rib for engaging said electrical contact when said inner housing is in said second latched position for retaining said electrical contact position.

7. The connector assembly of claim 1, wherein said outer housing includes at least one lug for being received by a strain relief member.

8. The connector assembly of claim 1, wherein said electrical contact includes at least one arcuate Beam for engaging a portion of said inner housing and thereby retaining said contact within said inner housing.

9. The connector assembly of claim 1, wherein said inner housing slot includes at least a pair of wire guide ribs.

10. The connector assembly of claim 1, wherein said inner housing is disposed in said outer housing cavity in said first latched position.

11. The connector assembly of claim 10, wherein said inner housing wall includes a primary latch recess which receives said latch arm in said first latched position.

12. The connector assembly of claim 12, wherein said inner housing is disposed in said outer housing cavity in said second latched position.

13. The connector assembly of claim 12, wherein said inner housing wall includes a secondary latch recess which receives said latch arm in said second latched position.

14. The connector assembly of claim 1, wherein said inner housing is disposed in said outer housing cavity in said first latched position so that a portion of said electrical contact is exposed.

15. The connector assembly of claim 14, wherein said exposed electrical contact portion comprises a first insulation displacement (IDC) section on said contact for termination with an electrical wire.

16. The connector assembly of claim 14, wherein said exposed electrical contact portion comprises a second insulation displacement (IDC) section on said contact for termination with an electrical wire.

17. The connector assembly of claim 16, wherein said second IDC section comprises at least one leg for engaging a portion of said inner housing thereby retaining said contact within said inner housing slot.

* * * * *